US008484998B1

(12) United States Patent
Pai

(10) Patent No.: US 8,484,998 B1
(45) Date of Patent: Jul. 16, 2013

(54) CIRCULAR KNITTING MACHINE WITH A FINE GAUGE

(75) Inventor: Tieh-Hsiung Pai, New Taipei (TW)

(73) Assignee: Pai Lung Machinery Mill Co., Ltd., New Taipei (TW)

( * ) Notice: Subject to any disclaimer, the term of this patent is extended or adjusted under 35 U.S.C. 154(b) by 0 days.

(21) Appl. No.: 13/608,144

(22) Filed: Sep. 10, 2012

(51) Int. Cl.
*D04B 27/04* (2006.01)

(52) U.S. Cl.
USPC ..... 66/8; 66/107

(58) Field of Classification Search
USPC ..... 66/8, 31, 91, 92, 93, 104, 105, 106, 66/107, 217
See application file for complete search history.

(56) References Cited

U.S. PATENT DOCUMENTS

| | | | | |
|---|---|---|---|---|
| 3,783,647 | A * | 1/1974 | Torrant et al. | 66/123 |
| 4,519,221 | A * | 5/1985 | Hirano | 66/107 |
| 5,327,748 | A * | 7/1994 | Izumi et al. | 66/121 |
| 6,199,409 | B1 * | 3/2001 | Shibata | 66/25 |
| 6,269,665 | B1 * | 8/2001 | Wang | 66/91 |
| 7,469,561 | B2 * | 12/2008 | Krauss | 66/115 |
| 7,980,100 | B2 * | 7/2011 | Lonati et al. | 66/106 |
| 2009/0314038 | A1 * | 12/2009 | Lonati et al. | 66/111 |

FOREIGN PATENT DOCUMENTS

| | | | |
|---|---|---|---|
| WO | WO 2008145433 | A1 * | 12/2008 |
| WO | WO-2012/055591 | A1 | 5/2012 |

* cited by examiner

*Primary Examiner* — Danny Worrell
(74) *Attorney, Agent, or Firm* — Muncy, Geissler, Olds & Lowe, PLLC

(57) ABSTRACT

A circular knitting machine with a fine gauge includes a circular cylinder and a sinker holder annularly located on an outer side of the circular cylinder. The circular cylinder has a plurality of knitting needles parallel with the axial direction of the circular cylinder to move alternately, and an annular top surface corresponding to the knitting needles. The sinker holder has a plurality of retaining slots to hold a plurality of sinkers. Each sinker has a slide edge, a movement edge extended from the slide edge at the same elevation to the annular top surface and located above the annular top surface, and a loop forming nose located between two neighboring knitting needles. Each retaining slot has a leaning surface in contact with the slide edge to allow the sinker to move towards the annular top surface to proceed a loop forming movement.

9 Claims, 4 Drawing Sheets

CIRCULAR KNITTING MACHINE WITH A FINE GAUGE

FIELD OF THE INVENTION

The present invention relates to a circular knitting machine and particularly to a circular knitting machine with a fine gauge.

BACKGROUND OF THE INVENTION

A conventional circular knitting machine mainly includes a circular cylinder to hold a plurality of vertical knitting needles and a circular sinker holder located on the circumference of the circular cylinder. The circular sinker holder holds a plurality of sinkers movable against the circular cylinder. The knitting needles and sinkers are respectively pushed by corresponding driving cams to move alternately to knit yarns.

In recent years, in order to improve quality and touch feeling of fabric, a circular knitting machine with a greater number of knitting needles has been developed. For instance, WO2012055591 discloses a knitting machine with a high gauge that includes a needle holder to hold a plurality of needles which can be driven to move alternately and axially along the needle holder, and a mechanism to guide the needles on the needle holder. Through a drawing motion of the alternate movements, the needle tip and a portion of needle stem are drawn from one end of the needle holder so that the knitted loop previously formed drops to the needle stem or one or more yarns are picked up to be fed to a yarn feeding spot or a yarn guide port. Through a retracting motion of the alternate movements, the needle together with the needle tip are retracted to the end of the needle holder to form a new knitting loop and also release the previously formed knitting loop to knitting them together. The guiding mechanism includes a channel to perform the knitting operation that is adjacent to the one end of the needle holder and a slide channel located in a zone between the needle holder and the one end of the needle holder. The channel for the knitting operation is engageable by a needle and defined with the inlet which is directed toward the outside of the needle holder the resting contact zone for knitting during the retracting motion of the needle. The number of the slide channels is less than that of the channels for performing the knitting operation.

In the conventional circular knitting machine, in order to allow the sinker to steadily move horizontally and reciprocally, aside from providing a plurality of housing slots on the circular sinker holder to hold the sinkers, the circular cylinder also has a plurality of holding slots to allow the noses of the sinkers to extend towards the knitting position above. In the aforesaid circular knitting machine with a greater number of knitting needles, when the number of the needles increases, the distance between the needles or sinkers, and the thickness of the needles and sinkers have to be shrunk. As a result, the distance between the holding slots for holding the sinkers on the circular cylinder also must be reduced. To accommodate to the technique of greater number of knitting needles, it is quite difficult to fabricate a greater number of narrow holding slots on the metallic circular cylinder, and production yield is lower as well. Moreover, as the sinkers often are in contact with the inner walls of the holding slots due to small tolerances, during knitting operation of the circular knitting machine, the thinner sinkers are easily damaged or deformed due to high temperature friction. Thus the damaged sinkers have to be replaced frequently. This is time consuming and costly.

On the other hand, during assembly and installation of the thinner sinkers, the sinkers have to be aligned precisely with the holding slots of the circular cylinder one by one. This also requires a lot of time. In the event that an error takes place in the assembly and installation, extra time and efforts are needed to do the assembly and installation anew. All this makes improving the production efficiency of the circular knitting machine with greater number of needles more difficult.

SUMMARY OF THE INVENTION

The primary object of the present invention is to solve the problem of the conventional circular knitting machine with a greater number of needles that has to fabricate a greater number of narrow holding slots on the circular cylinder to result in difficulty in assembly and installation and knitting of fabric.

To achieve the foregoing object, the present invention provides a circular knitting machine with a fine gauge that includes a circular cylinder and a sinker holder annularly located on an outer side of the circular cylinder. The circular cylinder has a needle holding surface, a plurality of knitting needles located on the needle holding surface and arranged in parallel with the axial direction of the circular cylinder to move alternately, and an annular top surface corresponding to the knitting needles and forming a bending angle against the needle holding surface. The sinker holder has a plurality of retaining slots to hold a plurality of sinkers therein. Each sinker has a slide edge, a movement edge extended from the slide edge at the same elevation to the annular top surface and located above the annular top surface, and a loop forming nose located between two neighboring knitting needles. Each retaining slot has a leaning surface in contact with the slide edge to allow the sinker to move towards the annular top surface to proceed a loop forming movement. Each knitting needle is formed at a thickness between 0.15 and 0.3 mm. The sinker is formed at a thickness between 0.1 and 0.15 mm.

In one embodiment the circular cylinder includes a gap formed between the movement edge and annular top surface.

In another embodiment the leaning surface is formed at an elevation higher than that of the annular top surface.

In yet another embodiment the knitting needle and sinker are spaced from each other at a distance ranged from 0.09 mm to 0.03 mm.

In yet another embodiment the needle holding surface includes a plurality of wedge slots parallel with the axial direction of the circular cylinder, a plurality of spacers each being located in one wedge slot and a plurality of spaces each being formed between two neighboring spacers to hold one knitting needle.

In yet another embodiment the needle holding surface holds the knitting needles in a juxtaposed manner at a density ranged from 40 to 80 pieces per inch.

In yet another embodiment the bending angle is 90 degrees.

In yet another embodiment each sinker includes a first thickness zone and a second thickness zone which is formed at a thickness greater than that of the first thickness zone.

In yet another embodiment the first thickness zone is located at an upper portion of the sinker, and the second thickness zone is at a lower portion of the sinker.

Because the circular knitting machine of the invention does not need to add holding slots on the circular cylinder, damage of the sinkers caused by high temperature friction during knitting operation can be reduced, and the lifespan of the sinkers can be prolonged. Moreover, time and process for assembly and installation of the sinkers are greatly reduced.

Production efficiency of the circular knitting machine with greater number of needles improves. In addition, the bottom of the sinkers is formed at the same elevation, hence the structural strength of the thinner sinkers also increases.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
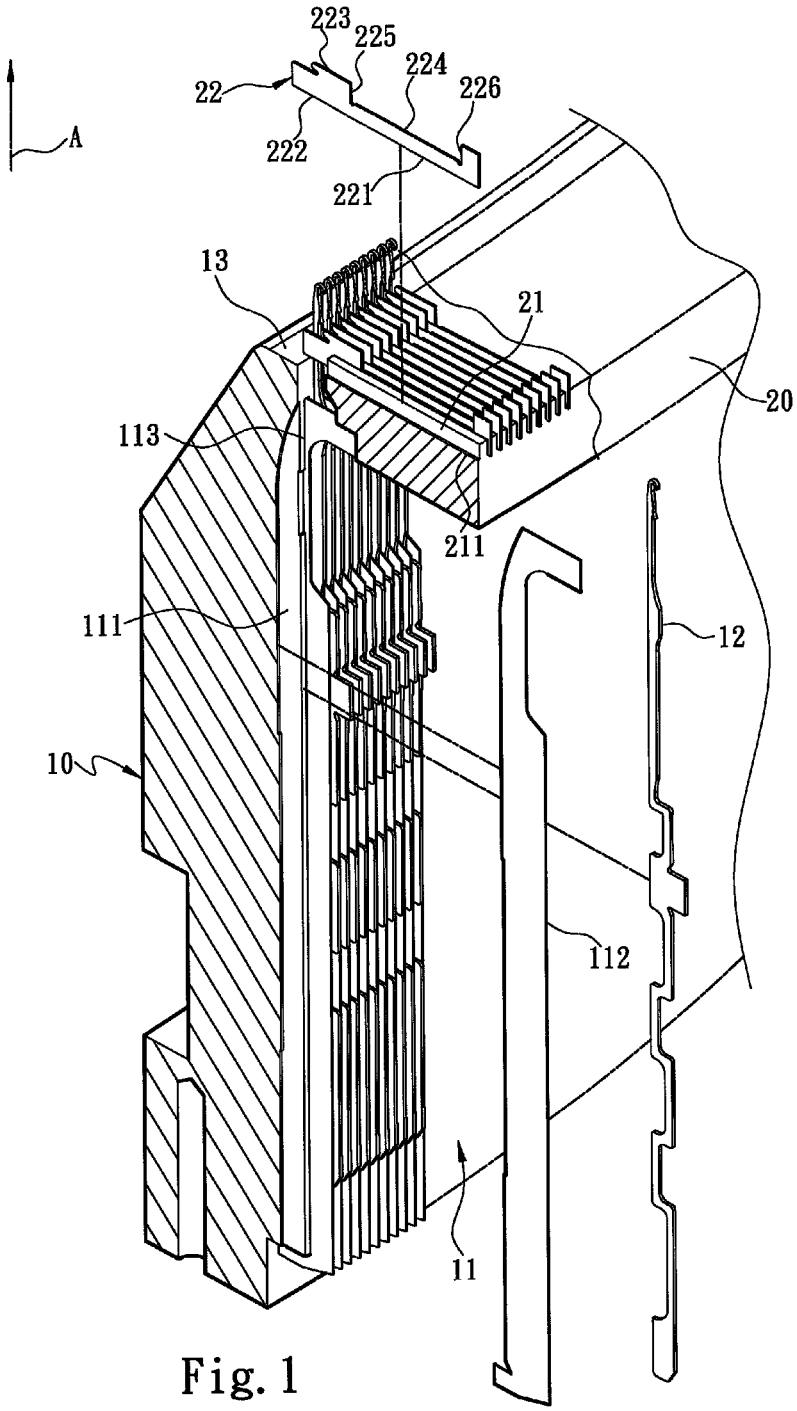
FIG. 1 is a fragmentary perspective view of an embodiment of the circular knitting machine with the fine gauge of the invention.
Figure 2:
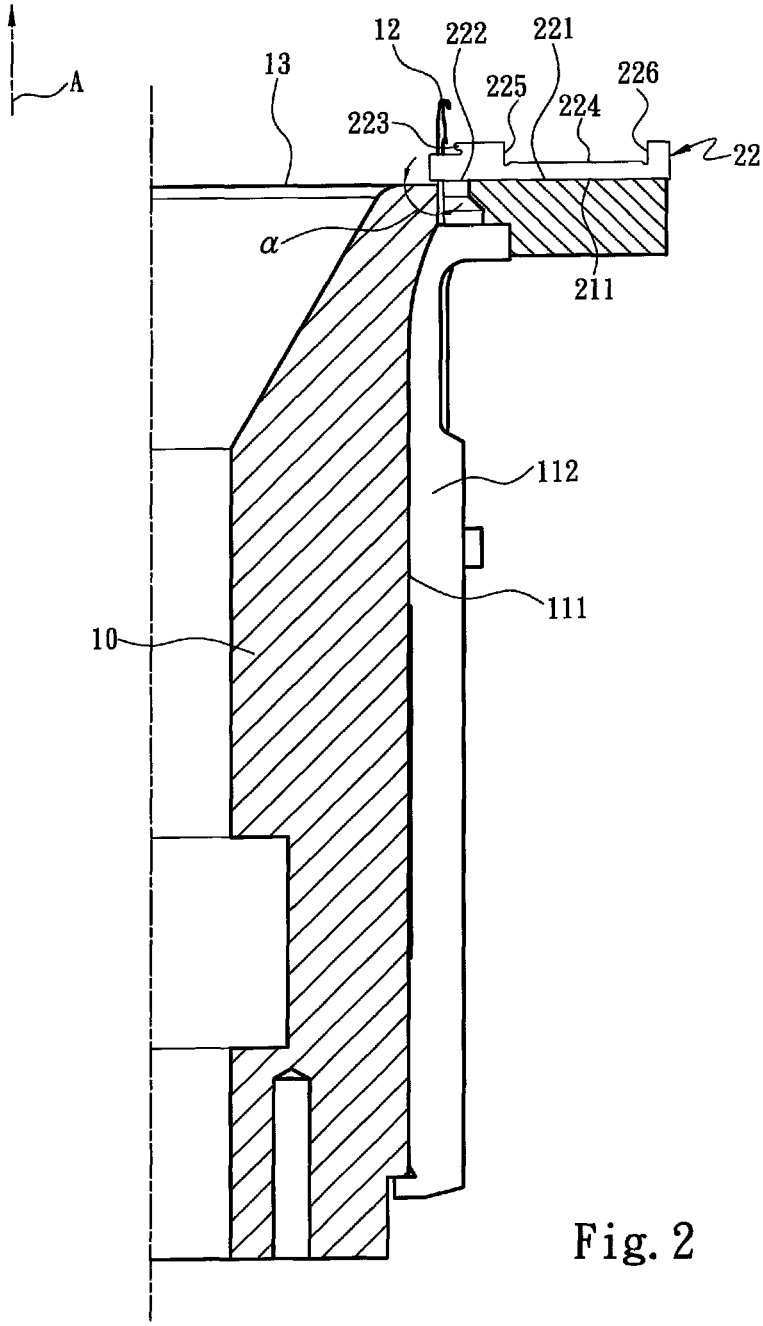
FIG. 2 is a fragmentary plane view of an embodiment of the circular knitting machine with the fine gauge of the invention.
Figure 3:
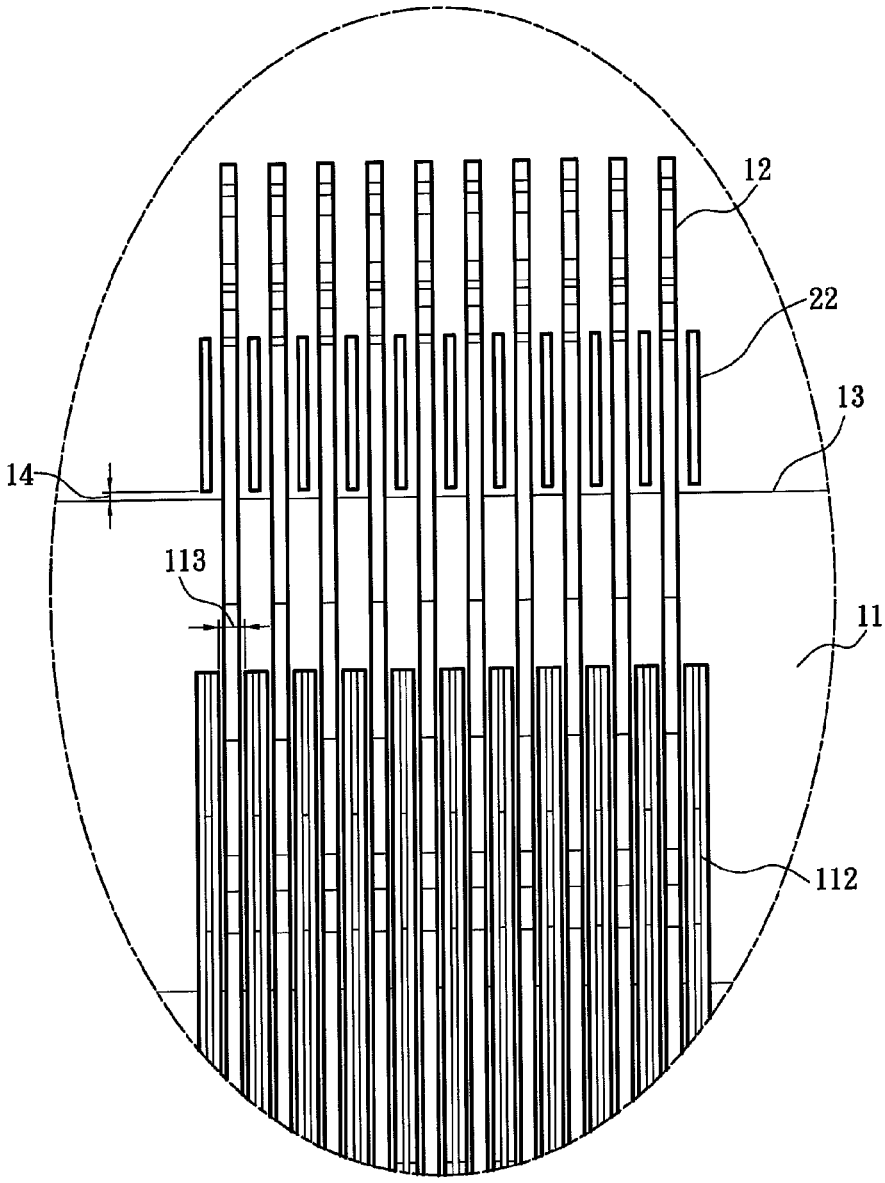
FIG. 3 is a fragmentary cross section of an embodiment of the circular knitting machine with the fine gauge of the invention.

Please refer to FIGS. 1, 2 and 3, the present invention aims to provide a circular knitting machine with a fine gauge that includes a circular cylinder 10 installed along an axial direction A and a sinker holder 20 annularly located on an outer side of the circular cylinder 10. The circular cylinder 10 has a needle holding surface 11 formed on an outer side thereof, a plurality of knitting needles 12 located on the needle holding surface 11 and arranged in parallel with the axial direction A of the circular cylinder 10 to move alternately, and an annular top surface 13 corresponding to the knitting needles 12 and forming a bending angle $\alpha$ against the needle holding surface 11. In this embodiment, the annular top surface 13 is perpendicular to the needle holding surface 11, i.e. the bending angle $\alpha$ is 90 degrees. In order to facilitate smooth alternate movement of the knitting needles 12 on the needle holding surface 11, the needle holding surface 11 has a plurality of wedge slots 111 in parallel with the axial direction A of the circular cylinder 10 and a plurality of spacers 112 each being held in one wedge slot 111, and a plurality of spaces 113 each being formed between two neighboring spacers 112 to hold one knitting needle 12.

The sinker holder 20 includes a plurality of retaining slots 21 and a plurality of sinkers 22 each being held in one retaining slot 21. Each sinker 22 has a slide edge 221 at the bottom, a movement edge 222 extended from the slide edge 221 at the same elevation to the annular top surface 13, a loop forming nose 223 movable alternately with the knitting needle 12, and a guide portion coupled with a driving cam (not shown in the drawings) to push the sinker 22 to proceed a loop forming movement. In this embodiment, the guide portion includes a guide slot 224 to hold the driving cam, a first butting edge 225 in the guide slot 224 close to one side of the loop forming nose 223, and a second butting edge 226 in the guide slot 224 at another side opposite to the first butting edge 225. When the driving cam pushes the first butting edge 225, the sinker 22 is moved towards the annular top surface 13; when the driving cam pushes the second butting edge 226, the sinker 22 is moved away from the annular top surface 13, thus the loop forming movement is formed. In addition, the retaining slot 21 of the sinker holder 20 also has a leaning surface 211 in contact with the slide edge 221 to allow the sinker 22 to move steadily to proceed the loop forming movement.

To reduce friction of the sinker 22 during the loop forming movement, in another embodiment of the invention, the circular cylinder 10 further has a gap 14 formed between the movement edge 222 and annular top surface 13, thereby the sinker 22 is not in direct contact with the annular top surface 13. Moreover, in the sinker holder 20, the leaning surface 211 is formed at an elevation higher than that of the annular top surface 13 so that when the sinker 22 is in the loop forming movement the probability of impacting the annular top surface 13 by the movement edge 222 that is formed at the same elevation as the slide edge 221 can be reduced.

Take a circular knitting machine with a base formed at a diameter of 30 inches as an example. The needle holding surface 11 holds the knitting needles 12 in a juxtaposed manner at a density from 40 to 80 pieces per inch. Relationship between different numbers and thicknesses of the knitting needles 12, different thicknesses of the sinkers 22 and distances between the knitting needles 12 and sinkers 22 is shown in the table below:

| Needle Number per inch | Needle thickness (mm) | Sinker thickness (mm) | Distance between the needle and sinker (mm) | Total needle number |
|---|---|---|---|---|
| 40 | 0.3 | 0.15 | 0.09 | 3768 |
| 42 | 0.3 | 0.15 | 0.075 | 3960 |
| 44 | 0.26 | 0.12 | 0.095 | 4140 |
| 46 | 0.26 | 0.12 | 0.085 | 4332 |
| 48 | 0.26 | 0.12 | 0.07 | 4512 |
| 50 | 0.26 | 0.12 | 0.06 | 4704 |
| 52 | 0.21 | 0.12 | 0.075 | 4896 |
| 54 | 0.21 | 0.12 | 0.065 | 5088 |
| 56 | 0.21 | 0.12 | 0.06 | 5280 |
| 58 | 0.21 | 0.12 | 0.05 | 5472 |
| 60 | 0.21 | 0.12 | 0.045 | 5640 |
| 62 | 0.18 | 0.1 | 0.06 | 5832 |
| 64 | 0.18 | 0.1 | 0.055 | 6000 |
| 66 | 0.18 | 0.1 | 0.055 | 6000 |
| 68 | 0.18 | 0.1 | 0.045 | 6408 |
| 70 | 0.18 | 0.1 | 0.04 | 6588 |
| 72 | 0.18 | 0.1 | 0.035 | 6768 |
| 74 | 0.18 | 0.1 | 0.03 | 6960 |
| 76 | 0.15 | 0.1 | 0.04 | 7128 |
| 78 | 0.15 | 0.1 | 0.035 | 7344 |
| 80 | 0.15 | 0.1 | 0.03 | 7488 |

Based on the table above, it can be seen that the thickness of the knitting needles 12 is ranged from 0.15 to 0.3 mm, the thickness of the sinkers 22 is ranged from 0.1 to 0.15 mm, and the distance between the knitting needles 12 and sinkers 22 is ranged from 0.09 to 0.03 mm.

Figure 4:
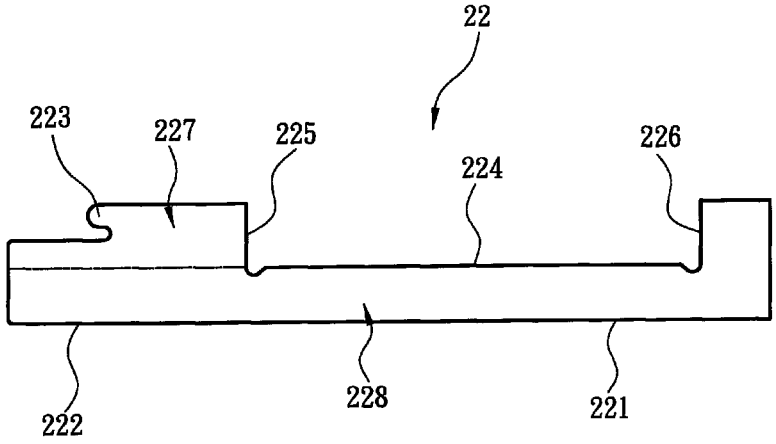
FIG. 4 is a schematic view of another embodiment of a sinker according to the invention.

In this embodiment, the sinker 22 can be formed at one thickness, or two different thicknesses. FIG. 4 illustrates another embodiment in which the sinker 22 has a first thickness zone 227 and a second thickness zone 228 formed at a greater thickness than the first thickness zone 227. The first thickness zone 227 is located at an upper portion of the sinker 22, and the second thickness zone 228 is at a lower portion of the sinker 22.

As a conclusion, the invention eliminates the holding slots provided above the circular cylinder for holding the sinkers in the circular knitting machine with the high gauge. Hence damage of the sinkers on the circular knitting machine with a greater number of knitting needles due to high temperature friction can be avoided. Moreover, the slide edge of the sinker in the retaining slot of the sinker holder and movement edge extended towards the annular top surface are formed at the same elevation, hence total structural strength of the thinner sinker increases. As a result, the lifespan of the sinkers is longer, and time and process for assembly and installation of the circular knitting machine with a greater number of knitting needles can be reduced.

While the preferred embodiments of the invention have been set forth for the purpose of disclosure, they are not the limitations of the invention, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A circular knitting machine with a fine gauge, comprising:

a circular cylinder including a needle holding surface, a plurality of knitting needles located on the needle holding surface and arranged in parallel with an axial direction of the circular cylinder to move alternately, and an annular top surface corresponding to the plurality of the knitting needles and a bending angle being formed between the annular top surface and the needle holding surface; and a sinker holder which is located annularly on an outer side of the circular cylinder and includes a plurality of retaining slots and a plurality of sinkers each being held in one of the plurality of retaining slots, each of the plurality of sinkers including a slide edge, a movement edge extended at a same elevation from the slide edge to the annular top surface and located above the annular top surface, and a loop forming nose located between two neighboring knitting needles, each of the plurality of retaining slots including a leaning surface in contact with the slide edge to allow the sinker to move towards the annular top surface to proceed a loop forming movement;

wherein each of the plurality of knitting needles is formed at a thickness ranged from 0.15 mm to 0.3 mm and each of the plurality of sinkers is formed at a thickness ranged from 0.1 mm to 0.15 mm.

2. The circular knitting machine of claim 1, wherein the circular cylinder includes a gap formed between the movement edge of the sinker and the annular top surface.

3. The circular knitting machine of claim 1, wherein the leaning surface is formed at an elevation higher than that of the annular top surface.

4. The circular knitting machine of claim 1, wherein the knitting needle and the sinker are spaced from each other at a distance ranged from 0.09 mm to 0.03 mm.

5. The circular knitting machine of claim 1, wherein the needle holding surface includes a plurality of wedge slots parallel with the axial direction of the circular cylinder, a plurality of spacers each being located in one of the plurality of wedge slots, and a plurality of spaces each being formed between two neighboring spacers to hold one knitting needle.

6. The circular knitting machine of claim 1, wherein the needle holding surface holds the plurality of knitting needles in a juxtaposed manner at a density ranged from 40 to 80 pieces per inch.

7. The circular knitting machine of claim 1, wherein the bending angle is 90 degrees.

8. The circular knitting machine of claim 1, wherein the sinker includes a first thickness zone and a second thickness zone formed at a thickness greater than that of the first thickness zone.

9. The circular knitting machine of claim 8, wherein the first thickness zone is located at an upper portion of the sinker and the second thickness zone is located at a lower portion of the sinker.

* * * * *